United States Patent [19]

Alford, Sr.

[11] 4,139,916

[45] Feb. 20, 1979

[54] RESPIRATORY TREATMENT BENCH AND CABINET

[76] Inventor: Varnal A. Alford, Sr., 700 Castle Dr., Chattanooga, Tenn. 37411

[21] Appl. No.: 872,687

[22] Filed: Jan. 26, 1978

[51] Int. Cl.[2] ..... A47B 83/00; A61G 7/00

[52] U.S. Cl. ..... 5/2 R; 5/63; 128/1 R; D6/64; D24/3; D24/17

[58] Field of Search ..... 5/2 R, 11, 63, 64, 65, 5/66, 60, 62; 128/1 R; D6/64; D24/3, 17

[56] References Cited

U.S. PATENT DOCUMENTS

| | | | |
|---|---|---|---|
| D. 209,904 | 1/1968 | Park et al. | D6/64 |
| 3,339,974 | 9/1967 | Park et al. | 297/377 |
| 3,423,773 | 1/1969 | Yamate | 5/66 |
| 3,643,604 | 2/1972 | Jones et al. | 5/63 |
| 3,660,591 | 5/1972 | Schultz et al. | 5/2 R |

FOREIGN PATENT DOCUMENTS

| | | | |
|---|---|---|---|
| 58426 | 4/1953 | France | 5/2 R |

*Primary Examiner*—Mervin Stein
*Assistant Examiner*—Alex Grosz
*Attorney, Agent, or Firm*—Harold C. Hogencamp

[57] ABSTRACT

A device comprising a work bench or table portion upon which a patient may lay in either of two prone positions, flat or inclined, during stages of a medical respiratory treatment and, as an integral portion thereof, a lock-cabinet for enclosing and safe-keeping of all pertinent medical equipment, medicines, and supplies required for such treatment. The device is physically arranged to provide the greatest possible convenience to the patient especially so for home treatment.

3 Claims, 6 Drawing Figures

RESPIRATORY TREATMENT BENCH AND CABINET

The invention herein disclosed relates to an improved device which is especially designed and constructed to be used as an aid in medical treatment. More specifically it is employed during the treatment of patients having respiratory ailments or diseases. I therefore term my device a RESPIRATORY TREATMENT BENCH AND CABINET.

As here used, BENCH is defined as a "long worktable," since medical treatment work is performed thereon.

In instances such as in cases of electrical shock or near-drowning only one emergency respiratory treatment — of extreme nature — is usually necessary.

However, in cases of respiratory ailments or diseases it is essential that treatment or treatments of less rigorous nature be repeated and continued daily for some duration of time. Commonly such treatments must be repeated several times a day, often for six months, two years, or even during the remaining lifetime of the patient.

With proper medical equipment available, and under a physician's direction, such prolonged treatments can be more conveniently and at less cost done at home and to a great extend by the patient himself. My RESPIRATORY TREATMENT BENCH AND CABINET is of its greatest usefulness under such circumstances — during lengthy periods of, partial self-service, treatments at home. Of course this device is also useful in hospitals and doctor's offices, and in conjunction with other types of medical treatment.

Wherever treatments are given but most particularly for home treatment it is obvious that it is advantageous and time-saving (as well as nerve-saving) to have all required medical equipment, medicines, and supplies not only readily available to the patient being treated, but also that they be close-at-hand, at just the position or location where they are to be used. The device of my invention as herein disclosed provides just such a self-contained and self-sufficient service.

It is to be realized that this is designed as a useful, convenient, and desirable device which is employed only as an adjunct or supplement to and in conjunction with the medical equipment, medicines, and supplies required for use during the prescribed treatment itself, and to safely store or contain such material between treatments.

A better understanding of how this device is used as an aid during respiratory treatments will be gained by a later description of the requirements and procedures for such treatments.

Taking into account the foregoing:

A prime object of the present invention is to provide an improved device designed to be advantageously used as an adjunct and/or supplement to the medical apparatus and medicines employed for treatment of respiratory ailments and diseases.

As equally important object is to include in this device means for providing every possible convenience and comfort to the patient.

Other important objects will become apparent from the following disclosure reference being made to the drawing, and the appended claims.

As an aid in describing the structure of this invention reference is here made to the FIGS. of the accompanying drawings in which like numerals designate like parts.

Figure 1:
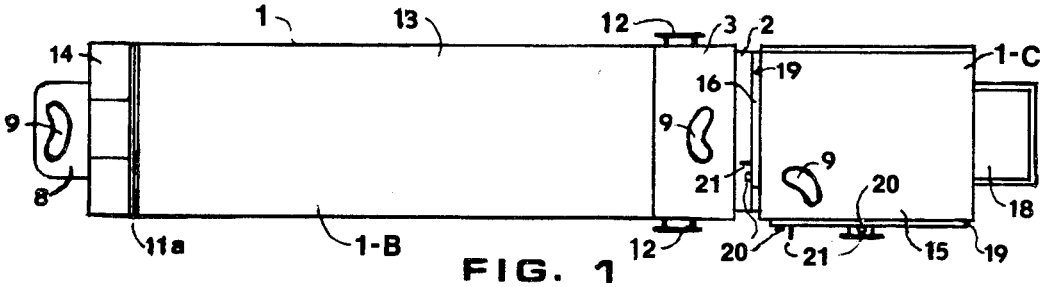
FIG. 1 is a top plan view of one preferred construction of my device.
Figure 2:
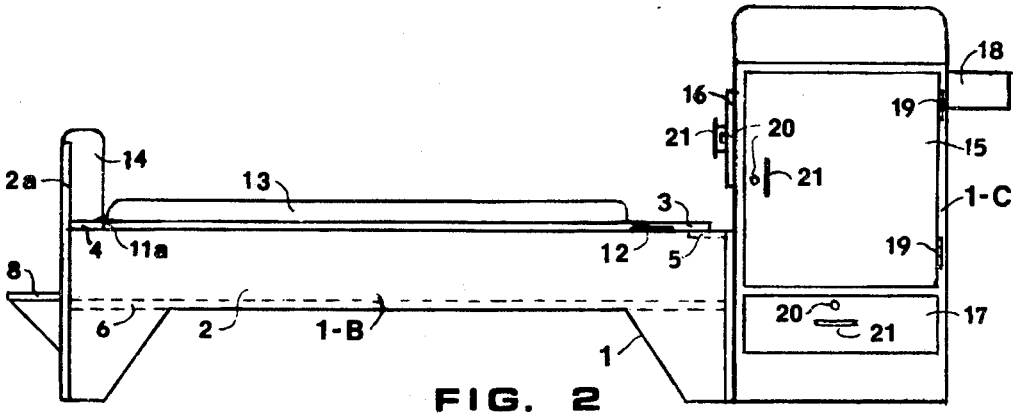
FIG. 2 is a plan face-view of the device shown in FIG. 1.
Figure 3:
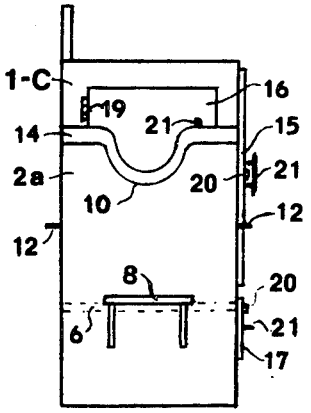
FIG. 3 is a left bench-end plan view of the device shown in FIG. 2.
Figure 4:
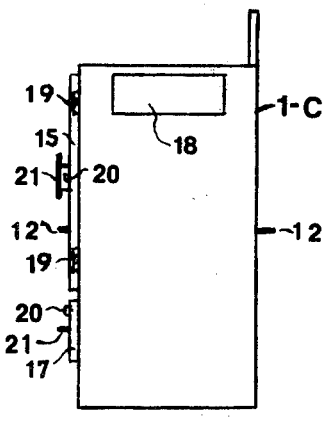
FIG. 4 is a right cabinet-end plan view of the device shown in FIG. 2.
Figure 5:
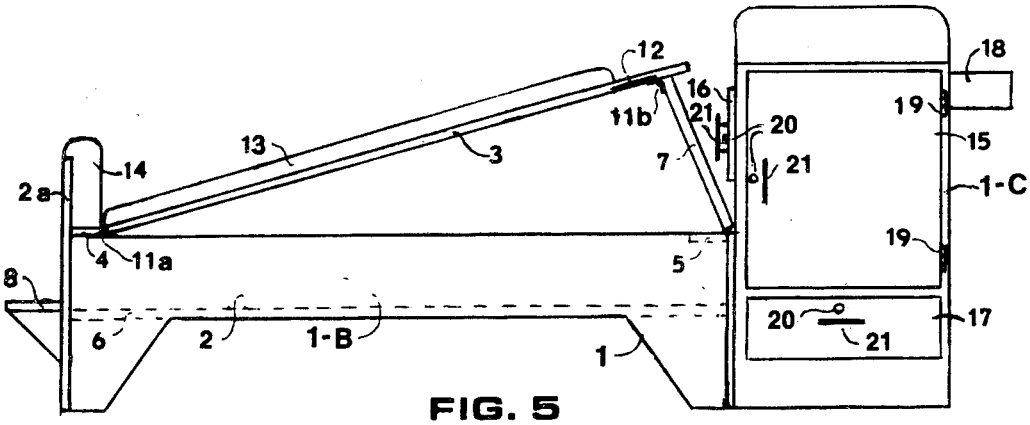

FIG. 5 shown a variation of the plan face-view of the construction shown in FIG. 2.

Figure 6:
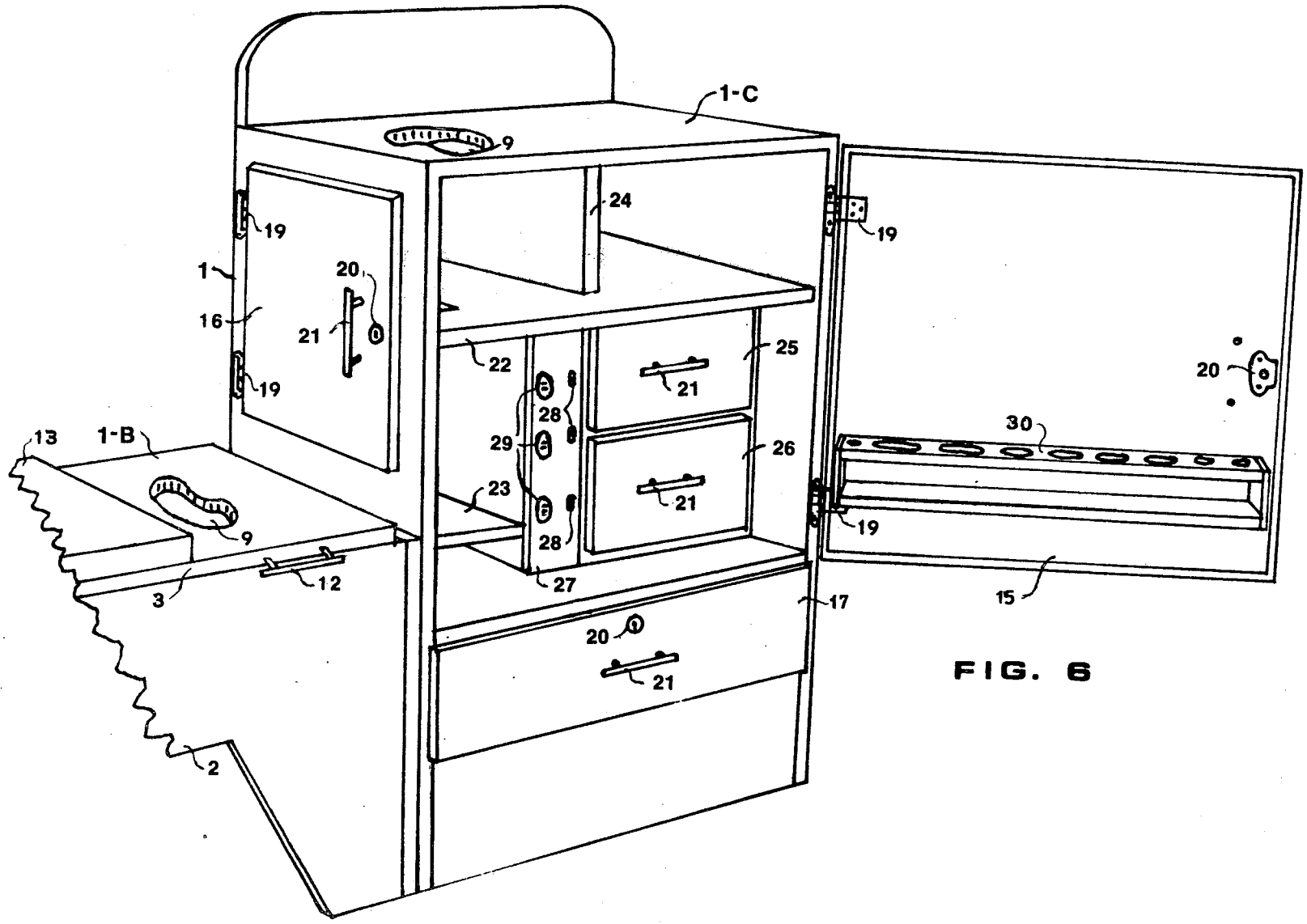

FIG. 6 is a larger size perspective view which particularly shows details of one preferred arrangement of the interior structure of the cabinet portion of the device depicted in previous drawing FIGS.

More specifically in the drawing: The entire assembled device, designated as 1, is comprised of bench portion 1-B and an adjoining cabinet portion 1-C.

The bench portion 1-B includes base 2, top 3 tiltable by reason of being attached at one end to piano hinge 11-A which is firmly fastened to crosspiece 4 at one end of said bench. In normal horizontal position, as shown in FIG. 2, bench top 3, in its other end area, rests on top-support piece 5. Tilt-support 7 attached at one end to bench top 3 by means of a like piano hinge 11-B is used to hold bench top 3 in its inclined position as depicted in FIG. 5, the lower end of tilt-support 7, then resting on top-support piece 5 as indicated. By the addition of a bottom piece 6 a storage space is provided in the bench portion 1-B. Shelf 8 at the end of base 2 and bench top 3 have openings 9—9 therein for holding emesis basins (not shown or claimed). At the same end of base 2 as shelf 8 is an upwardly extending head-board 2-A having in it an essentially semi-circular cut-out 10 for head support. Bench top padding 13 and head-rest padding 14 are atop the bench and handles 12—12 are attached to bench top 3 as aids in raising it to its inclined position and lowering it therefrom.

The cabinet portion 1-C is an enclosure positioned in juxtaposed relationship to bench portion 1-B and is an integral part of the entire assembled device 1. Outwardly cabinet 1-C has a front door 15, a side door 16, and external drawer 17, and a bracket 18 for holding tissues. Doors 15 and 16 are each supported by two hinges 19—19. Drawer 17 as well as the two doors are equipped with locks 20 and pull-handles 21. An opening 9 in the top surface of cabinet 1-C is similar to openings 9—9 in the bench portion 1-B and is likewise used for holding an emesis basin.

The interior of cabinet 1-C is preferably sub-divided to contain shelves, such as those designed as 22 and 23; divider 24 separating shelf 22 in order to provide a left and a right compartment for housing medical equipment. Interior drawers numbered 25 and 26 each have a pull-handle 21. An electrical panel 27 is also included, with electric switches 28 and corresponding electric outlets 29, controlled by switches 28 and into which the medical equipment (not shown or claimed) can be connected. A medicine rack 30, having openings therein for holding medicine bottles and containers, is mounted on the inner surface of door 15.

It will be realized that certain advance preparation must initially be made in order for my device to become fully operative and to use it most advantageously and most conveniently as a supplement during the treatment of a patient.

First the cabinet portion must be fitted with all medical equipment, medicines, and supplies used as the prime factors in such treatment.

Shelves are provided in the interior of the enclosed cabinet for holding and storing the required medical equipment as are drawers for medicines and supplies. A rack mounted on the inside surface of the front door of the cabinet is provided with suitable openings and spaces for the medicines which are immediately needed. An electrical panel is included for plug-in connection and control of the electrically energized medical equipment. All materials contained within the cabinet are safely protected "under lock and key" while stored therein between treatments: Thus it can be certain that everything necessary is ready and available at the start of each treatment.

Additionally, an external drawer, with lock, is large enough to be used for storage of any reserve or duplicate medical equipment. A rack is provided for holding tissues as are openings appropriately positioned atop the cabinet portion and in the bench portion for placement of emesis basins.

Therefore it will be seen that, when thus properly fitted out, the unit is self-contained and self-sufficient and is ready to meet every requirement for use in giving respiratory medical treatment.

In order to clearly show the potential need, usefulness, advantages, and convenience of my invention I will hereby briefly describe one typical medically approved and successful type of medical treatement employed in cases of respiratory ailments and diseases. Of course the treatment should be prescribed by and be given or taken under the direction of a physician.

For such treatment the essentials are: (1) An electric-actuated breathing machine (such as a Bennett A.P.5); (2) An electric-energized vaporizer (such as a Devilbiss 145A); (3) An electric-operated percussor (such as Storm Model 181); (4) Prescribed medicines: for use in the breathing machine (such as Bronchosol or Isurrel or equivalent); for use in the vaporizer; and to be taken orally; plus incidentals like tissues and emesis basins; and (5) For greatest comfort during treatment, the padded tilt-top bench of the presently disclosed invention.

Each of the four-times-a-day treatments, employing my Respiratory Bench and Cabinet as an adjunct to the medical material, consists of three consecutive stages. Each stage utilizes a different piece of medical equipment and each requires a different physical position of the patient.

For most convenience during use, the breathing machine is best placed on upper shelf 22, to the left of divider 24, and with its front facing outward toward side door 16. It can remain so-positioned during and between its use for treatments. The vaporizer is placed on bottom shelf 23 facing side door 16, while the percussor is kept on upper shelf 22 to the right of divider 24 for storage and is removed therefrom only for its usage during treatments.

Stage I of Treatment

Patient, in standing posture, breathes deeply through mouthpiece of tube from operating breathing machine; the nembutiler bowl on mouthpiece being initially filled with the medicine prescribed by doctor. This stage of deep-breathing is continued for approximately 15 or 20 minutes — until nembuliter bowl is emptied. As necessary and as fluid and secretion is released it is expectorated into an emesis basin.

Employing my device during this stage of treatment: Patient stands at front of cabinet portion 1-C, unlocks and opens both doors, 15 and 16, and takes out the mouthpiece end of the breathing machine hose (still attached to the machine at the other end). The prescribed medicine is removed from rack 30 and the nembutilier bowl is filled with the proper amount of such medicine. Preparation is thus completed for Stage 1 of treatment. With mouthpiece of tube in patient's mouth, the breathing machine, already connected to it's designated electric outlet 29 mounted on panel 27 is turned on by the corresponding switch 28. Patient starts taking deep breaths through mouthpiece and continues until nembuilier bowl is emptied of medicine. Fluid and secretion released from lungs can be expectorated into the emesis pan positioned in the opening 9 for same in top of cabinet 1-C and most convenient to the patient who is standing along side cabinet 1-C. After completion of its use the breathing machine is de-activated by means of its switch 28 and the hose is placed back into cabinet 1-C for storage until it is next to be used. Stage I of treatment is now finished. If medicine is to be taken orally at the end of this phase of the treatment it is readily available from rack 30. As for all three stages of treatment, reserve supplies of medicines are kept in drawer 25 or drawer 26. Tissues are near-by in box contained in bracket 18 and any additional required supplies are kept in either drawer 25 or drawer 26. Larger back-up medical equipment is stored in outer drawer 17 and safely locked therein. Accessories such as scales or even a medical-sized oxygen tank can be kept in the large storage space in bench portion 1-B.

Stage II of Treatment

Patient laying prone on flat horizontal surface, deeply inhales the prescribed medicated steam emanating from an electrically heated vaporizer into his lungs and continues to do so for some 15 or 20 minutes. As phlem, fluid, or secretion is released it is expectorated into an emesis basin.

Employing my device during this stage of treatment: With doors 15 and 16 still open, as they remain during all three stages of treatment; the vaporizer is prepared for use by pouring in the specified amount of water and medicine. The medicine prescribed for this use is conveniently kept in a container in rack 30 and is available therefrom. Vaporizer is them activated by turning on the proper electric switch 28 mounted in electrical panel 27; the vaporizer being plugged into corresponding electric outlet 29. Patient then lays down in prone position on padding 13 atop flat bench top 3 with head to end which is of adjacent to side opening (side door 16 being open) of cabinet 1-C. Bench top 3 as here used remains in its normal horizontal position, as shown in FIG. 2. As the fluid in the vaporizer reaches the required heat, steam comes forth from its spout which is pointed outwardly from the open side of cabinet 1-C and is directed toward the face of the patient laying on bench 1-B. Patient deeply inhales this medicated steam into his lungs and continues to do so for about 15 or 20 minutes. Phlegm, fluid, and secretion can be expectorated into the emesis basin held in the opening 9 in bench top 3 which is conveniently located below the patient's head and close to his mouth. Patient gets several tissues held in bracket 18 before lying down. At end of this phase of treatment electricity for heating the vaporizer is turned off by its related switch 28. Vaporizer remains in cabinet 1-C for safe-keeping. Any medicine to be taken orally after this is also to be found in rack 30.

Stage III of Treatment

Patient lays in prone position with head lower than feet — preferably on an inclined plane surface — for postural drainage. This final stage of treatment is one of physiotherapy, employing a percussor machine which must be manipulated by some person other than the patient himself. The percussor produces a "tapping" and is utilized by being directly applied to the back of the patient. Generally an elongated fiture-eight continuous movement of the percussor is employed, alternately moving the percussor up-and-down lengthwise of the spine and perhaps about 2 inches on either side of it starting at waist going up. This is continued for 15 or 20 minutes without stopping the percussor or removing it from contact with the patient's back. Secretion is thus forced out of the lungs and is expectorated as might be necessary.

Employing my device during this stage of treatment: In preparation; padded bench top 3 is tilted from its normally horizontal position, as shown in FIG. 2, to the inclined position shown in FIG. 5. This is done by using handles 12—12 to raise the cabinet end of bench top 3 which is attached to piano hinge 11-A at its other end. Tilt or incline support 7, attached by piano hinge 11-B to top 3, is then moved to its upright position with its lower end resting on bench-top support 5 (FIG. 5). Bench top 3 is thereby held and supported in an inclined position and is ready for occupancy by the patient. The patient then positions himself face-down on bench top 3 with feet toward cabinet end, resting his body on top of padding 13 and with his head or neck resting on the head-rest padding 14 in indentation 10 of bench 1-B. Patient is now ready for treatment; prone and with head lower than feet. Attendant or assistant removed the percussor from its storage place on upper shelf 22 of cabinet 1-C and activates it by means of proper connected electric switch 28 and outlet 29 on electrical control panel 27. Attendant then positions operating percussor on patient's back and begins its prescribed movement thereon, continuing for the desired 15 or 20 minutes. The emesis pan is opening 9 of shelf 8 of bench 1-B is conveniently located under mouth of patient so that he can expectorate the secretion brought up from lungs into it as is necessary. When this final stage of treatment is completed the percussor is turned off, by switch 28, and is placed back in its storage place on shelf 22, in cabinet 1-C to await its use as required during next treatment. Patient then, of course, removes himself from bench top. Any additional prescribed oral medicine is obtained from rack 30 and taken by patient. Treatment is completed.

Obviously the three emesis basins (normally set in openings 9—9—9) should be cleaned after use. Tissues from holder 18 are available to wipe out the basins but preferably they should be washed out after each treatment or at least once a day. Likewise all medical equipment should be cleaned as is needed after each usage.

At the end of each treatment all equipment, medicines, and supplies are put back in cabinet 1-C and, being sure that all electric switches 28 are turned off, doors 15 and 16 and drawer 17 are closed and locked to assure safekeeping of all materials utilized for such respiratory treatment and to make sure that everything is readily and conveniently available for use during the next treatment.

From the foregoing brief description of the three stages entailed in such medical treatments it becomes obvious that use of the device herein disclosed as my invention is not mandatory, vital, or even essential in providing these treatments. However, the several added advantages and conveniences which become obtainable through use of my device as a supplement to any in conjunction with the required medical equipment should also be plain to understand and the valuable human aspects and assets of my invention should be realized.

In its capacity as an already well-tested and proven adjunct the device herein described accomplishes even more than its physical functions — and this, too, is of extreme importance.

By realization that all of the necessary medical equipment, medicines, and supplies are safely on hand in the locked cabinet and that the adjustable padded bench will provide the most comfort possible, the patient is kept in a more relaxed state of mind when it is time to take a crucial treatment. He is mentally more receptive to treatment and is therefore more benefitted by it.

Keep in mind that usually four such treatments are required each day — continuing for months or even for years. State-of-mind therefore is of great importance to the success of these multiplicity of treatments. Aside from other factors my Respiratory Treatment Bench and Cabinet, because of being self-contained and self-sufficient, and meeting as far as is possible every need in the most convenient way, therefore can and does provide means for supplying a valuable service in the treatment of respiratory diseases. In addition, note that by use of this bench, the patient is positioned in required position for treatment everytime.

Details of actual physical construction and/or materials used for such construction are not here given since the desirable features of the device can be attained with varying methods of construction. Also, modifications can be made without limiting the scope of the invention. For instance: Although not shown, it is obvious that rollers or casters could be attached to enhance the mobility of the device; interior shelves and drawers might be rearranged; and mechanical means might be included for tilting the bench top and supporting it at different angles of incline. These and other such modifications would not alter the basic concepts of my invention, and should not restrict it.

Having here disclosed my invention, what I claim as new and desire to protect by Letters Patent is:

1. A respiratory treatment bench and cabinet device constituted of an adjustable worktable portion and a cabinet enclosure portion combined as integral parts thereof in firmly attached juxtaposed relationship to form a common single entity: said worktable or bench portion comprising a horizontally oriented base structure enclosing a storage area, a solid one-piece elongated flat top hinged at one end to said base enclosure, padding atop of said flat bench top, means for tilting said hinged top comprising a tilt support hingedly attached at the other end of said flat top, means for firmly holding and supporting said top in either a horizontal or an inclined position, a head board attached to and extending upwardly from said one end of said base structure; said adjoining enclosed cabinet portion being firmly affixed to the base structure of said bench portion and including at least one external door, locks for said door or doors, and interior shelves and drawers.

2. The device as set forth in claim 1 including an electrical control panel positioned inside of said cabinet enclosure having electric switches and electric outlets mounted thereon.

3. The device of claim 1, wherein the headboard is padded and it has a semi-circular cut out for head support.

* * * * *